US007886675B2

(12) United States Patent
Johnson et al.

(10) Patent No.: US 7,886,675 B2
(45) Date of Patent: Feb. 15, 2011

(54) FUEL IGNITION SYSTEMS

(75) Inventors: J. Evan Johnson, Minnetonka, MN (US); Scott H. Bents, River Falls, WI (US)

(73) Assignee: Thermetic Products, Inc., Minneapolis, MN (US)

( * ) Notice: Subject to any disclaimer, the term of this patent is extended or adjusted under 35 U.S.C. 154(b) by 101 days.

(21) Appl. No.: 12/388,084

(22) Filed: Feb. 18, 2009

(65) Prior Publication Data

US 2009/0233250 A1 Sep. 17, 2009

Related U.S. Application Data

(63) Continuation of application No. 11/273,589, filed on Nov. 14, 2005, now abandoned.

(51) Int. Cl.
*F23L 15/00* (2006.01)
*F23G 5/10* (2006.01)

(52) U.S. Cl. ..... 110/302; 110/254; 110/250; 431/11

(58) Field of Classification Search ..... 110/250, 110/254, 302; 431/6, 11, 67, 207, 208, 211, 431/213, 258; 461/36, 41; 126/68, 73, 77, 126/107, 117, 190, 284; 122/4 D; 361/264; 123/556

See application file for complete search history.

(56) References Cited

U.S. PATENT DOCUMENTS 3,630,184 A 12/1971 Wolf et al.
3,720,496 A 3/1973 Briggs
4,593,340 A 6/1986 Meyer
4,606,320 A 8/1986 McGee
4,723,065 A 2/1988 Meyer
5,040,497 A 8/1991 Dingle
5,055,032 A 10/1991 Altemark et al.
5,133,266 A 7/1992 Cullen (Continued)

FOREIGN PATENT DOCUMENTS

EP 0 191 910 B1 1/1990

OTHER PUBLICATIONS

"Application of Ceramic Tubes in High Temperature Furnaces", *Proceedings of the* 1986 *International Gas Research Conference,* pp. 875-888.

"Ceramic Tube Heat Recuperator - A User's Experience", Patrick W. Ward et al., 1984, pp. 31-42.

"Ceramic Tube Materials and Processing Development - Topical Report", K.E. Green et al., Feb. 1982-Dec. 1984, pp. i-ii, iv-vii, and 1-42.

*Primary Examiner*—Kenneth B Rinehart
*Assistant Examiner*—David J Laux
(74) *Attorney, Agent, or Firm*—Patterson Thuente Christensen Pedersen, P.A.

(57) ABSTRACT

Disclosed is a furnace adapted for burning solid materials, including biomass fuels. The furnace comprises an igniter having a heating element carried by a ceramic core and disposed within a ceramic cover tube for directing air at fuel disposed within the furnace for the purpose of igniting the fuel. Also disclosed is an igniter having a heating element carried by a ceramic core and disposed within a ceramic cover tube for directing air at fuel disposed within the furnace for the purpose of igniting the fuel.

10 Claims, 4 Drawing Sheets

U.S. PATENT DOCUMENTS 5,248,252 A 9/1993 Delichatsios et al.
5,378,956 A 1/1995 Salzmann et al.
5,435,718 A 7/1995 Briggs
5,551,992 A 9/1996 Fraas
5,590,526 A 1/1997 Cho
6,223,737 B1 5/2001 Buckner
6,401,669 B1 6/2002 Macgowan et al.
2007/0107642 A1 5/2007 Johnson et al.

FUEL IGNITION SYSTEMS

CROSS-REFERENCE TO RELATED APPLICATIONS

This application is a Continuation of application Ser. No. 11/273,589, filed Nov. 14, 2005, which application is incorporated herein in their entirety by reference.

FIELD OF THE INVENTION

The present invention is related to furnaces, in particular furnaces for burning biomass and to igniters for such furnaces.

BACKGROUND OF THE INVENTION

Biomass is gaining popularity as a replacement fuel for fossil fuels such as coal, natural gas and petroleum-based products such as fuel oil. The energy stored in a biomass fuel ultimately comes from the same source as fossil fuels, solar energy. The process of photosynthesis captures the solar energy and stores it by creating carbon-carbon bonds. This stored energy can be released by burning or oxidation, breaking the bonds and generating gaseous carbon typically in the form of carbon dioxide. The burning of fossil fuels, therefore, releases carbon into the atmosphere that has otherwise been stored under the earth's surface for millions of years whereas burning of biomass such as wood, corn and other plant material releases gaseous carbon into the atmosphere that was removed only recently through the photosynthetic process.

A number of hurdles exist to utilizing biomass fuels on a widespread basis. For example, storage and conveyance of biomass fuels to the furnace can be a burden that may put off many potential users of biomass fuels. However, a number of biomass fuels, such as most cereal grains, fruit pits, weed seeds, wood pellets, plastic pellets and other pelletized fuels, are easily stored and conveyed.

Dried, shelled corn is often used because of its availability. In addition, dried corn is often much cheaper on a British Thermal Unit ("btu") basis for generating heat when compared to generating heat using electricity, LP gas, fuel oil and coal. This is especially true where the corn to be burned is not desirable for use in food or feed applications and can be obtained at a discount relative to other higher grade corn. Dried, shelled corn can also be conveyed and transported in a manner that is straightforward and routine due to its use in agricultural settings.

The burning of biomass fuels typically leaves ash and residues in amounts that are greater than fossil fuel burning. Fuels such as corn also leave a slag or clinkers after burning. Mechanisms for removal of these residual materials has been largely operated manually by the user, however newer units are becoming available that make the removal of these residuals more automatic.

Furnaces for burning of biomass and, in particular, corn are known and have been disclosed previously in US20040200394 and US20050208445, the disclosures of which are both incorporated by reference in their entirety. Such corn stoves are available, for example from Nesco, Inc. (Cookeville, Tenn.) under the AMAIZABLAZE trademark. Another such corn stove may be obtained EvenTemp, Inc. (Waco, Nebr.) under the SaintCroix trademark. Yet another such corn stove may be obtained from Bixby Energy Systems (Rogers, Minn.). These corn stoves incorporate features that make corn burning more convenient and reliable, overcoming many of the previously described difficulties associated with burning corn.

Consistent and reliable components for fuel ignition are also important in biomass fuel burning. The fuel must be rapidly and reliably brought to a temperature where the fuel burns, thereby releasing a greater amount of heat energy. One such ignition system that can be employed is an air or gas ignition system in which ambient or pre-warmed air is passed over or brought into contact with a heating element, thereby warming the air to a sufficient temperature to ignite the fuel. The elements are typically disposed within a cover tube. Prior art igniters have used materials that do not provide for optimum durability and conveyance of heat to the fuel. Durability of the tube is especially important where air flow through the tube may be interrupted.

While attempts have been made to overcome the problems described, it would be desirable to have a furnace for burning of biomass materials with an igniter optimized for ignition of such biomass materials.

SUMMARY OF THE INVENTION

The present invention is directed toward an apparatus for burning solid fuel, wherein the apparatus has a burning chamber for receiving fuel in communication with a fuel inlet, an air inlet, an exhaust outlet and at least one igniter and the at least one igniter includes at least i) an inlet block defining a channel therethrough, the inlet block including structure defining first, second and third orifices in communication with the channel; ii) a seal disposed within the second orifice; iii) a ceramic cover tube having first and second ends, the first end of the ceramic cover tube operably secured in the first orifice to the inlet block and the second end in communication with the burning chamber; a ceramic core disposed within the ceramic cover tube, v) a heating element carried by the core, and vi) electrical leads in electrical communication with first and second ends of the heating element, the electrical leads passing through the seal. The apparatus further includes a control circuit connected to the electrical leads, a gas source in communication with the third orifice for forcing a gas through the channel, into the ceramic cover tube, and out through the second end of the ceramic cover tube into the burn pot assembly. The apparatus may also have a fuel feed mechanism in communication with the fuel inlet. The fuel to be burned in the apparatus may be a biomass fuel and may be dried, shelled corn. In another embodiment, the ceramic cover tube of the at least one igniter is constructed from a ceramic such as alumina, mullite or corderite. In yet another embodiment, the ceramic core of the at least one igniter is constructed from a ceramic such as alumina, mullite or corderite. In some embodiments, the ceramic cover tube has an outer diameter of about 0.5 inches. In other embodiments, the heating element of the at least one igniter is rated between 300 and 600 watts at 120 volts AC and may be rated at 500 watts at 120 volts AC. In yet another embodiment, the gas source delivers a gas flow of 25-30 SLPM at 25-35 IN-WC to the inlet box. It will be understood that the descriptions various embodiments of the apparatus for burning solid fuel presented in this Summary of the Invention are not intended to be mutually exclusive.

The present invention is also directed toward an igniter, wherein the igniter includes an inlet block defining a channel therethrough, the inlet block including structure defining first, second and third orifices in communication with the channel, and a ceramic cover tube having first and second ends, the first end of the ceramic cover tube secured in the first orifice to the inlet block and a ceramic core disposed within the ceramic cover tube, and a heating element carried by the core, and at least one electrical lead in electrical communication with a first end of the heating element, the at least one electrical lead passing through the second orifice. In many embodiments, the igniter may also include a second electrical lead is connected to a second end of the heating element, the second electrical lead passing through the second orifice and the second orifice may sealed against airflow. In some embodiments, the ceramic cover tube is constructed from a ceramic such as alumina, mullite or corderite. Also, in some embodiments, the ceramic core may be constructed from a ceramic such as alumina, mullite or corderite. The ceramic core may also be hollow. In some embodiments, the heating element of the at least one igniter is rated between 300 and 600 watts at 120 volts AC and may be rated at about 500 watts at 120 volts AC. In some embodiments, the ceramic cover tube has an outer diameter of about 0.5 inches. Finally, in some embodiments, the temperature of the gas exiting the ceramic cover tube is about 1100°-1300° C. when the heating element is connected to a 120 volt AC power source and gas is delivered at 25-30 SLPM at 25-35 IN-WC. It will be understood that the descriptions various embodiments of the igniter presented in this Summary of the Invention are not intended to be mutually exclusive.

DETAILED DESCRIPTION OF THE PREFERRED EMBODIMENTS

Figure 1:
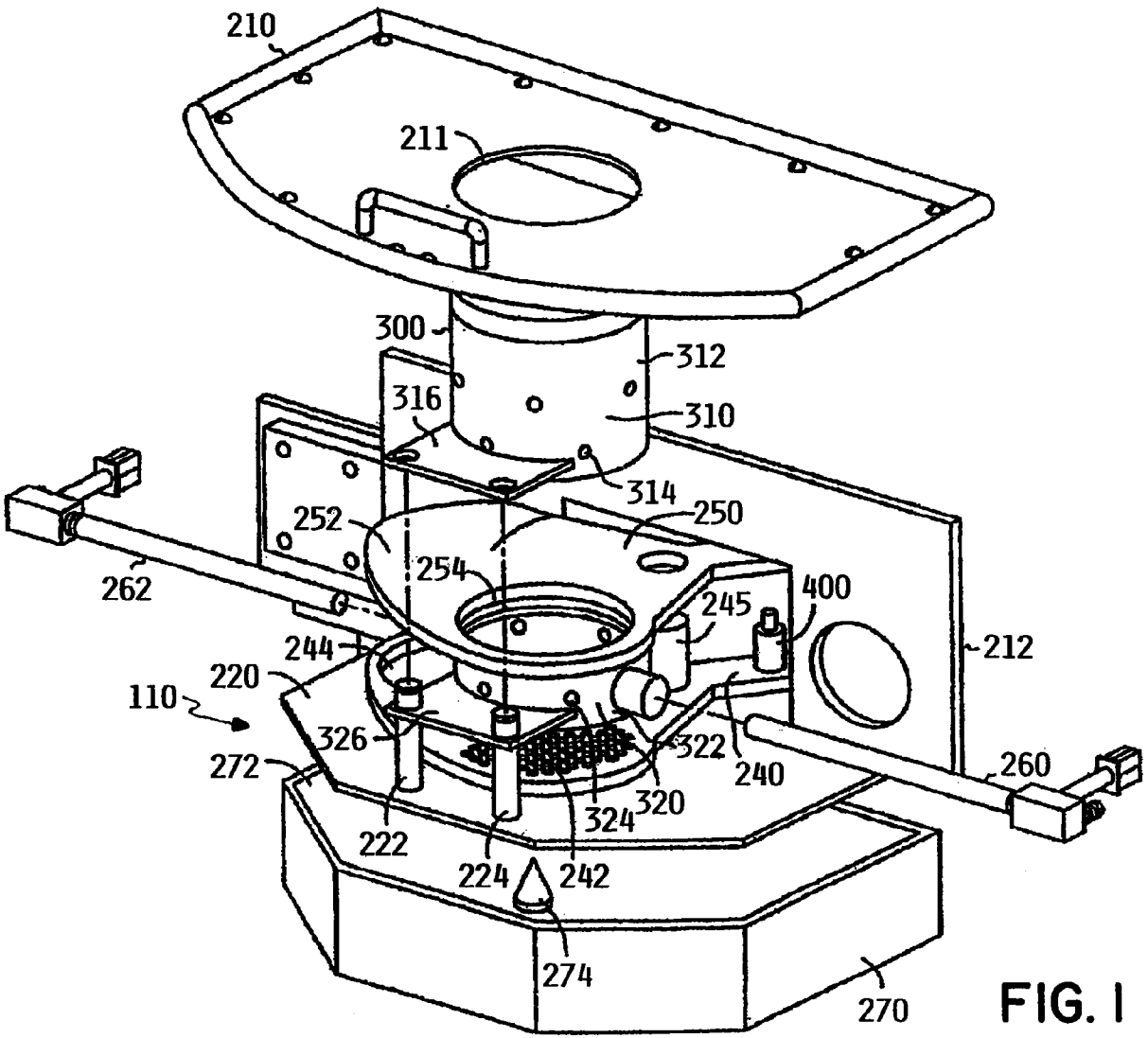
FIG. 1 shows an exploded view of a combustion chamber and burn pot of a prior art corn burning furnace.

FIG. 1 is an exploded perspective view of a portion of the combustion chamber 110 and the burn pot 300 of the furnace 100, according to an embodiment of the invention disclosed in US 20050208445. The combustion chamber 110 is bounded by a top burner plate assembly 210 and a bottom plate 220. The combustion chamber also includes a back wall 212. Attached to the bottom plate 220 is a first pin 222 and a second pin 224. The burn pot assembly 300 includes a first burn pot portion 310 and a second burn pot portion 320. The first burn pot portion includes a side wall 312. The side wall 312 has openings, such as opening 314 therein, for directing combustion air around the burn pot assembly 300. The second portion of the burn pot 320 also has a side wall 322. The sidewall 322 also includes openings, such as opening 324, for directing air entering from outside the burn pot assembly 300 to within the burn pot assembly. Also attached to the side wall 322 of the second burn pot portion 320 is a mounting wing 326. The mounting wing 326 includes openings that allow the mounting wing 326 to fit over the first pin 222 and the second pin 224 attached to the bottom plate 220 of the combustion chamber 110. Attached to the side wall 312 of the first burn pot portion is another mounting wing 316, which has opening therein so that the mounting wing 316 also fits over the first pin 222 and the second pin 224 of the bottom plate 220 of the combustion chamber 110.

Also located within the combustion chamber is a movable floor 240 and a translating plate 250. The movable floor includes a grill 242 and an opening 244. The movable floor 240 is attached to a pivot pin 245 so that the moving floor 240 can pivot around the pivot pin 245. The translating plate 250 also has an opening 254 therein. The translating plate 250 also includes a solid surface area 252. The translating plate 250 also is pivotally attached to the pivot pin 245. An actuator rod 400 is attached to the movable floor 240 as well as the translating plate 250. The actuator rod 400 is used to move the movable floor 240 and the translating plate 250 between a first position and a second position. In some embodiments, separate actuator rods are used to move the movable floor 240 and the translating plate 250.

Also attached to the burn pot assembly 300, and specifically to the second portion of the burn pot 320, is an igniter 260 and an igniter 262. The igniters 260, 262 place heated air into the burn pot assembly 300. The igniters 260, 262 are in fluid communication with the interior portion of the burn pot assembly. The igniters 260, 262 are used to initially fire the furnace or to initially ignite biomass fuel added to the burn pot assembly 300. Once the biomass fuel within the burn pot has been started, the igniters 260, 262 no longer place heated air into the burn pot assembly 300.

Improved igniter 500 may be constructed as follows. A heating element 532, prepared from nichrome wire, is disposed along the surface of a ceramic core 530 between a first end and a second end of the ceramic core. The length and thickness of the nichrome wire used in the heating element may be determined by one of skill in the based on the desired wattage of the element. For example, an element having a wattage of 300 watts would require thinner wire and possibly less total wire than an element having a wattage of 600 watts.

In one embodiment, a first electrical lead 511 is attached to a first end 546 of heating element 532 at the first end 542 of ceramic core 530 either directly or by a connecting wire 538 with optional connector 540 and a second electrical lead 513 may be attached to a second end 548 of heating element 532. Electrical leads 511, 513 may be connected directly to a control circuit within the furnace or may terminate within a connector 515 that allows for straightforward connection and removal of the electrical leads with the furnace. The control circuit controls flow of power to the heating element 532 and usually will be used at the beginning of a burn operation. The ignition, or the time the heating element is on and gas is flowing into the burn pot assembly, may be from five to fifteen minutes and may be about ten minutes.

Figure 4:
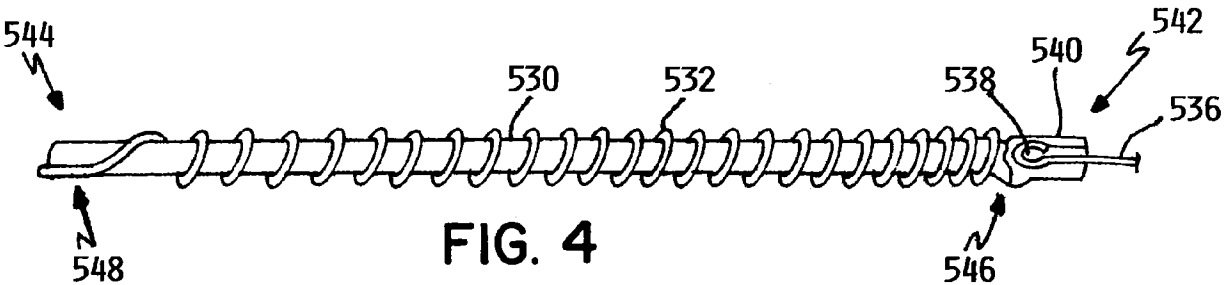
FIG. 4 shows a side view of a core carrying a heating element.
Figure 5:
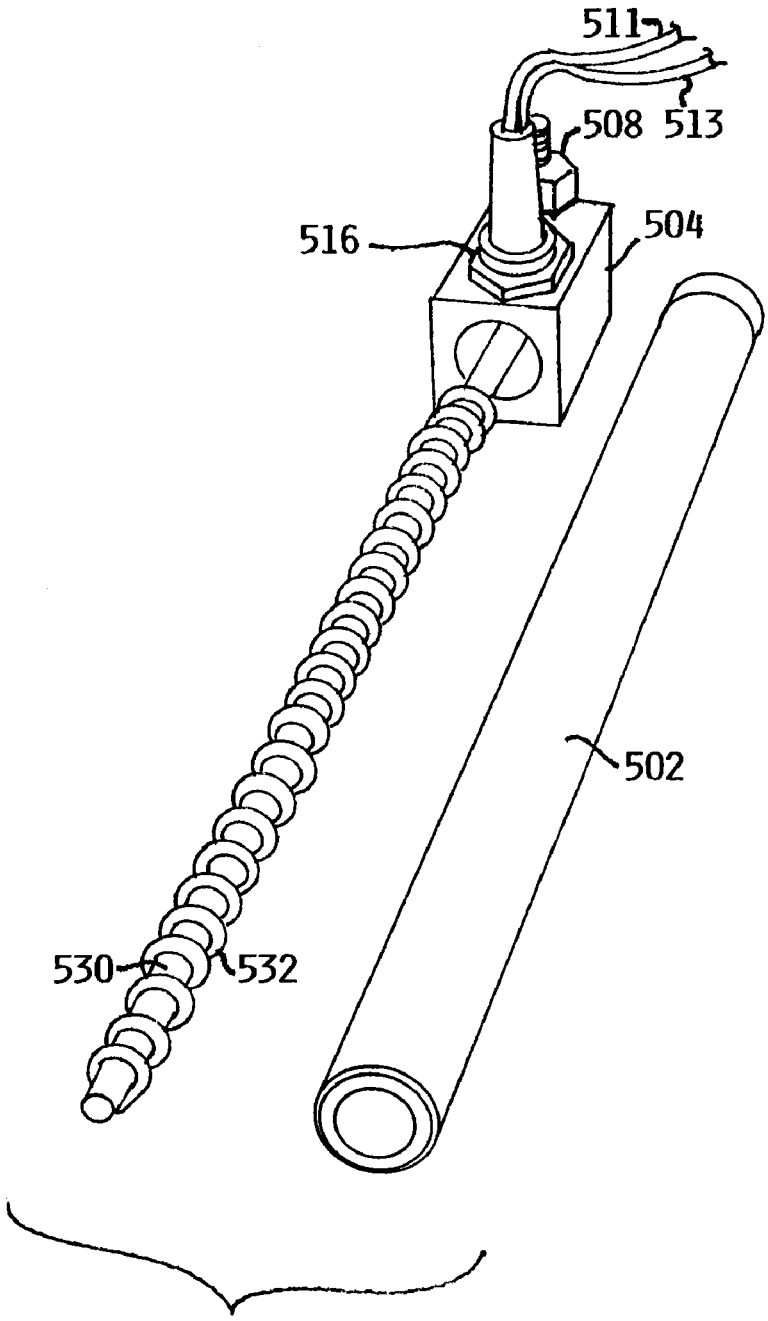
FIG. 5 show a perspective view of an igniter of the present invention with the cover tube removed showing the heating element carried by the core.

FIG. 4 shows another embodiment of the ceramic core in which heating element 532 is wound around ceramic core 530 between first 542 and second 544 ends of ceramic core 530 and first electrical lead 511 is attached directly or through an electrical connection (including, for example, end wire 538 and connector 540) to first end 546 of heating element 532 at or near first end 542 of ceramic core 530 as above. However, in this embodiment ceramic core 530 is hollow and an unsheathed wire 536 is attached to the second end 548 of heating element 532 at or near the second end 544 of ceramic core 530 and unsheathed wire 536 passes through the ceramic core to the first end 542 of ceramic core 530 where unsheathed wire 536 is attached to the second electrical lead 513 directly or through an electrical connection. Where ceramic core 530 is hollow, either of first end 542 or second end 544 of ceramic core 530 may be sealed with application of inorganic ceramic cement.

The attachment of heating element 532 to electrical leads 511, 513 and of electrical leads 511, 513 to wire connectors may be by direct mechanical contact, by weld, solder or other type of connection. In both embodiments, the electrical leads are passed into inlet block 504 through first orifice 514 and exit inlet block 504 through second orifice 516. Second orifice 516 may then sealed in a manner that prevents air or gas flow from the channel through second orifice 516.

First end 518 of ceramic cover tube 502 may then be inserted over ceramic core 530 and heating element 532 and into first orifice 514. Ceramic cover tube 502 may then be secured in place by application of an inorganic ceramic cement or other heat resistant material to the junction of ceramic cover tube 502 and inlet block 504. Ceramic cover tube 502 may be secured within first orifice 514 to be parallel in both X and Y axes relative to inlet block 504 with plus or minus one-sixteenth of an inch. Ceramic cover tube may have a outer diameter of 0.50 inches +/−0.015 inches. The length of ceramic cover tube 502 from inlet block 504 to second end 520 of ceramic cover tube 502 may be approximately 7.7 inches and inlet block 504 and may be approximately 1.5 inches along the side and approximately 0.75 inches square on the ends. When ceramic cover tube 502 is fully inserted into inlet block 504, the second end of ceramic core 530 should be set back from second end 520 of ceramic cover tube 502. This setback may be 0.5 to 2 inches and may be one inch.

Figure 2B:
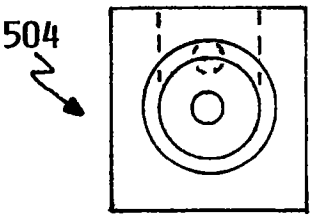
FIG. 2*b* shows an end view of an inlet block for an igniter of the present invention.
Figure 2A:
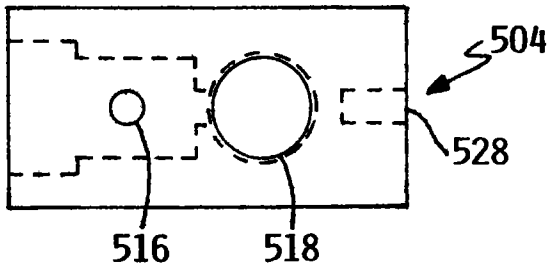
FIG. 2*a* shows a top view of an inlet block for an igniter of the present invention.
Figure 2C:
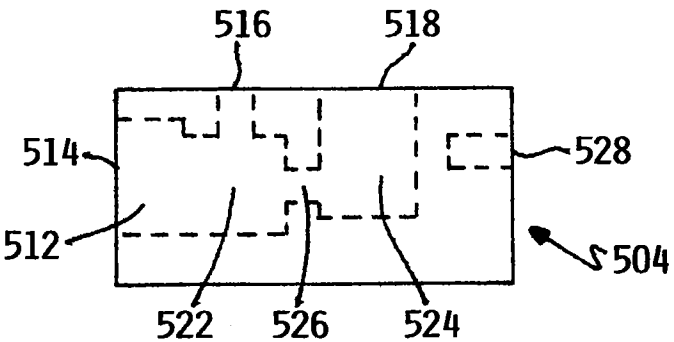
FIG. 2*c* shows a side view of an inlet block for an igniter of the present invention.
Figure 3:
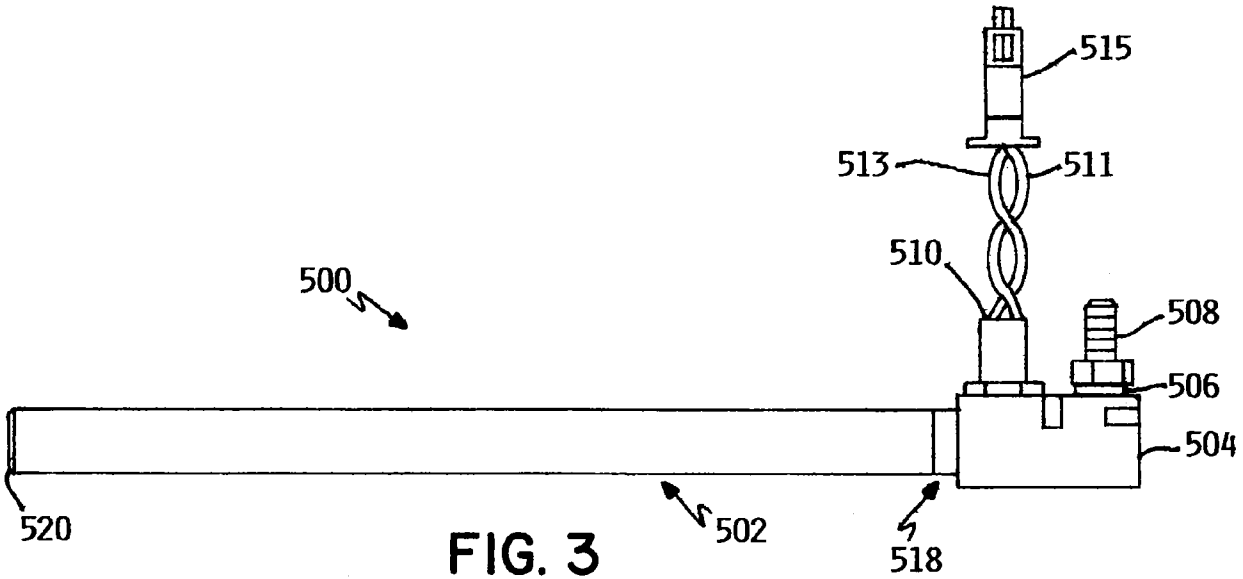
FIG. 3 shows a side view of an igniter.

FIG. 2*a*, FIG. 2*b* and FIG. 2*c* show top, end, and side views, respectively of an inlet block 504 according to the present invention. Inlet block 504 may be constructed from stainless steel, such as 304SS, or from plated steel, such as nickel plated steel. Inlet block 504 defines a channel 512 in communication with three orifices. Channel 512 and the orifices may be constructed by drilling to various depths at the various widths required for each orifice. For example, channel 512 may be constructed drilling five holes to form the first, second and the third orifices to form channel 512 as shown, for example, in FIG. 2*c*. A first orifice receives a first end the cover tube of the igniter and therefore must be wide enough and deep enough to securely receive the cover tube. Second orifice 516 must be of sufficient diameter to accommodate one or more electrical leads. Third orifice 518 provides fluid communication between a gas source [not shown] and channel 512 and may be threaded to receive a fitting 508 or adapter that can facilitate connection of inlet block 504 to the gas source. It will be understood that the placement of third orifice 518 need not be adjacent or on the same surface as second orifice 516. Fitting 508 may be a brass fitting having ⅛" NPT×¼" Hose Barb. Seal 506, such as a seal constructed from TEFLON material may be interposed between fitting 508 and inlet block 504 to ensure the connection between these two elements is able to withstand the pressures generated by the gas source. In embodiments where two electrical leads are connected to the heating element, inlet block 504 may also be grounded. Inlet block 504 may further define hole 528 which may in turn be threaded to enable acceptance of a screw or other connection for a grounding wire.

The gas source may be a pump to deliver ambient air at a pre-defined pressure; alternatively the gas source may be a tank containing a pressurized gas, such as oxygen. Suitable pumps include the GAST-30B pump available from Gast Manufacturing, Inc. (Benton Harbor, Mich.), the Thomas-5030 available from Thompson Pump & Machinery (Slidell, La.), the AL-30B and the Alita 15B both available from Alita Industries (Arcadia, Calif.). Gas flow may be in the range of 20-35 Standard Liters per minute (SLPM) at 25-35 inches of water column (IN-WC) and may be in the range of 25-30 SLPM at 25-35 IN-WC. Excessive gas flow may cause localized rapid burning of fuel, potentially leading to rapid outgassing of trapped moisture. The effect may appear to be similar to popping of corn Inlet block 504 may further define a channel comprising two chambers: a first chamber 522 in communication with the first and second orifice and a second chamber 524 in communication with third orifice 518, the first and second chambers in communication each in communication with a fourth orifice 526 defined by inlet block 504 and disposed between the first and second chambers. Fourth orifice 526 may be sized to regulate the flow of gas from second chamber 524 to the first chamber 522 to achieve a desired pressure to be applied to first end 518 of ceramic cover tube 502.

The ceramic material used in the construction of the ceramic core and ceramic cover tubes may be alumina or mullite or other aluminum-containing ceramics. These materials have low thermal expansion, good strength including at the temperatures achieved within the igniter and interlocking grain structure and therefore have desirable thermal shock and thermal stress qualities. Corderite may also be used in the construction of the ceramic core and ceramic cover tubes. Electrical leads should be able to withstand the temperatures generated within the inlet block and may be 20 gauge, 600 volt UL 1659 wire with insulation rated to 200° C. or 250° C. Inorganic ceramic cements should able to withstand the high temperatures and pressures generated within the igniter. Such cements are commercially available from a number of sources including Sauereisen, Inc. (Pittsburgh, Pa.).

In operation, the air source will be engaged to direct air into the third orifice through the channel exiting via the first orifice and passing through the ceramic cover tube. Once the flow of air or gas has been established, electrical power (e.g. 120 VAC) may be applied through electrical leads to the heating element. As the element heats, the air or gas passing through the cover tube will be warmed. The temperature of the air or gas exiting the ceramic cover tube may be 900°-1500° or 1100°-1300°.

The present invention has been described with respect to particular illustrative embodiments. It is to be understood that the invention is not limited to the above-described embodiments and modifications thereto, and that various changes and modifications may be made by those of ordinary skill in the art without departing from the spirit and scope of the appended claims.

What is claimed:

1. An apparatus for burning solid fuel, comprising:

a) a burning chamber for receiving solid fuel in communication with a solid fuel inlet, an air inlet, an exhaust outlet and at least one igniter, the at least one igniter comprising i) an inlet block defining a channel therethrough, the inlet block including structure defining first, second and third orifices in communication with the channel;

ii) a seal disposed within the second orifice;

iii) a ceramic cover tube having first and second ends, the first end of the ceramic cover tube operably secured in the first orifice to the inlet block and the second end in communication with the burning chamber;

iv) a ceramic core disposed within the ceramic cover tube, v) a heating element carried by the core, and vi) electrical leads in electrical communication with first and second ends of the heating element, the electrical leads passing through the seal; and b) a control circuit connected to the electrical leads; and c) an ambient air source in communication with the third orifice for forcing ambient air through the channel, into the ceramic cover tube, over the heating element and out through the second end of the ceramic cover tube into the burning chamber such that the ambient air is heated to a temperature sufficient to ignite the solid fuel.

2. The apparatus of claim 1, wherein the apparatus further comprises a fuel feed mechanism in communication with the fuel inlet.

3. The apparatus of claim 2, wherein the fuel is a biomass fuel.

4. The apparatus of claim 3, wherein the biomass fuel is dried, shelled corn.

5. The apparatus of claim 1, wherein the ceramic cover tube of the at least one igniter is constructed from a material selected from the group consisting of alumina.

6. The apparatus of claim 1, wherein the ceramic core of the at least one igniter is constructed from a material selected from the group consisting of alumina, mullite and corderite.

7. The apparatus of claim 5, wherein the ceramic cover tube has an outer diameter of about 0.5 inches.

8. The apparatus of claim 1, wherein the heating element of the at least one igniter is rated between 300 and 600 watts at 120 volts AC.

9. The apparatus of claim 8, wherein the heating element of the at least one igniter is rated at about 500 watts at 120 volts AC.

10. The apparatus of claim 9, wherein the gas source delivers a gas flow of 25-30 SLPM at 25-35 IN-WC.

* * * * *